US006886230B2

(12) United States Patent
Dagot

(10) Patent No.: US 6,886,230 B2
(45) Date of Patent: May 3, 2005

(54) BUSHING DRIVER

(76) Inventor: Alonzo Dagot, 1046 - 106 Street NW, Edmonton, Alberta (CA), T6J 6G8

( * ) Notice: Subject to any disclaimer, the term of this patent is extended or adjusted under 35 U.S.C. 154(b) by 0 days.

(21) Appl. No.: 10/744,816

(22) Filed: Dec. 23, 2003

(65) Prior Publication Data

US 2004/0143947 A1 Jul. 29, 2004

(30) Foreign Application Priority Data

Jan. 27, 2003 (CA) ..... 2417498

(51) Int. Cl.[7] ..... B25B 27/19
(52) U.S. Cl. ..... 29/275
(58) Field of Search ..... 29/275, 280, 255, 29/259, 263, 282

(56) References Cited

U.S. PATENT DOCUMENTS

| | | | | |
|---|---|---|---|---|
| 1,863,956 A | * | 6/1932 | Wilson | 29/275 |
| 2,916,813 A | | 12/1959 | Belanger | 29/256 |
| 3,408,724 A | | 11/1968 | Hoeijenbos | 29/263 |
| 3,740,814 A | | 6/1973 | Marshall | 29/200 |
| 4,047,771 A | | 9/1977 | Vaughn et al. | 308/237 |
| 4,263,705 A | | 4/1981 | Devening | 29/256 |
| 2,614,318 A | | 10/1982 | McCord | 29/263 |
| 4,724,608 A | | 2/1988 | Parrott | 29/724 |
| 4,951,374 A | | 8/1990 | Barry | 29/240 |
| 5,075,948 A | | 12/1991 | Maier | 29/264 |
| 5,218,749 A | * | 6/1993 | Upthegrove | 29/275 |
| H1349 H | | 9/1994 | Kelley | 29/259 |
| 5,713,117 A | | 2/1998 | Bliss | 29/257 |
| 5,848,460 A | | 12/1998 | Rasmussen et al. | 29/263 |
| 5,875,534 A | | 3/1999 | Jackson | 29/255 |
| 5,898,985 A | | 5/1999 | Villarreal | 29/257 |
| 6,357,096 B1 | | 3/2002 | James et al. | |

OTHER PUBLICATIONS

OTC catalog A–86, "Tools and equipment for the professional", *Bushing, Bearing and Seal Driver Sets*, 1986, 2pgs.
MAC Tools catalog, "Getting the Job Done", *Special Application Pullers and Accessories*, 1997, 3 pgs.
Snap–On catalog, "Qualify Tools and Service Equipment", *Inserted/Remover Set*, 2001, 3 pgs.
Snap–On website, Driver, Bushing (For A1S7C, A1588 or A257 Bushing Driver Sets), 2002, 1 pg.

* cited by examiner

*Primary Examiner*—Robert C. Watson
(74) *Attorney, Agent, or Firm*—Davis & Bujold, P.L.L.C.

(57) ABSTRACT

A bushing driver includes a first body and a second body. The first body has a first end and a second end. A new bushing interface is positioned adjacent the first end of the first body. An anvil is positioned at the second end of the first body. The second body has a first end and a second end. A worn bushing interface is positioned adjacent to the first end of the second body. A coupling is provided for detachably coupling the second end of the second body to the first end of the first body, with the worn bushing interface axially aligned with the new bushing interface. As a worn bushing is driven out by the worn bushing interface on the second body, a new bushing positioned on the new bushing interface is concurrently driven into the space vacated by the worn bushing.

3 Claims, 2 Drawing Sheets

BUSHING DRIVER

This application claims priority from Canadian Application Serial No. 2,417,498 filed Jan. 27, 2003.

FIELD OF THE INVENTION

The present invention relates to a bushing driver

BACKGROUND OF THE INVENTION

Bushing drivers perform two functions. They are used to remove worn bushings and they are used to install new bushings. This is a two step procedure as the worn bushing must be removed before the new bushing can be installed. Bushing drivers have a bushing interface at one end and an anvil at the other end. The bushing interface is brought into contact with the bushing and then the anvil is struck with a hammer to either drive the worn bushing out or drive the new bushing in.

SUMMARY OF THE INVENTION

What is required is a bushing driver which is capable of installing a new bushing concurrently with the removal of the worn bushing.

According to the present invention there is provided a bushing driver which includes a first body and a second body. The first body has a first end and a second end. A new bushing interface is positioned adjacent the first end of the first body. An anvil is positioned at the second end of the first body. The second body has a first end and a second end. A worn bushing interface is positioned adjacent to the first end of the second body. Means is provided for detachably coupling the second end of the second body to the first end of the first body with the worn bushing interface axially aligned with the new bushing interface. As a worn bushing is driven out by the worn bushing interface on the second body, a new bushing positioned on the new bushing interface is concurrently driven into the space vacated by the worn bushing.

The bushing driver, as defined above, is labour saving as it concurrently performs the operations of removing the worn bearing and inserting the new bearing.

There are various ways in which the second body may be detachably coupled to the first body. Beneficial results have been obtained when either the second end of the second body or the first end of the first body has a threaded male coupling. The other is provided with a threaded female coupling, whereby the first body and the second body are detachably coupled.

There are various types of bushing interfaces which can be used. Beneficial results have been obtained when the bushing interface is an annular flange.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
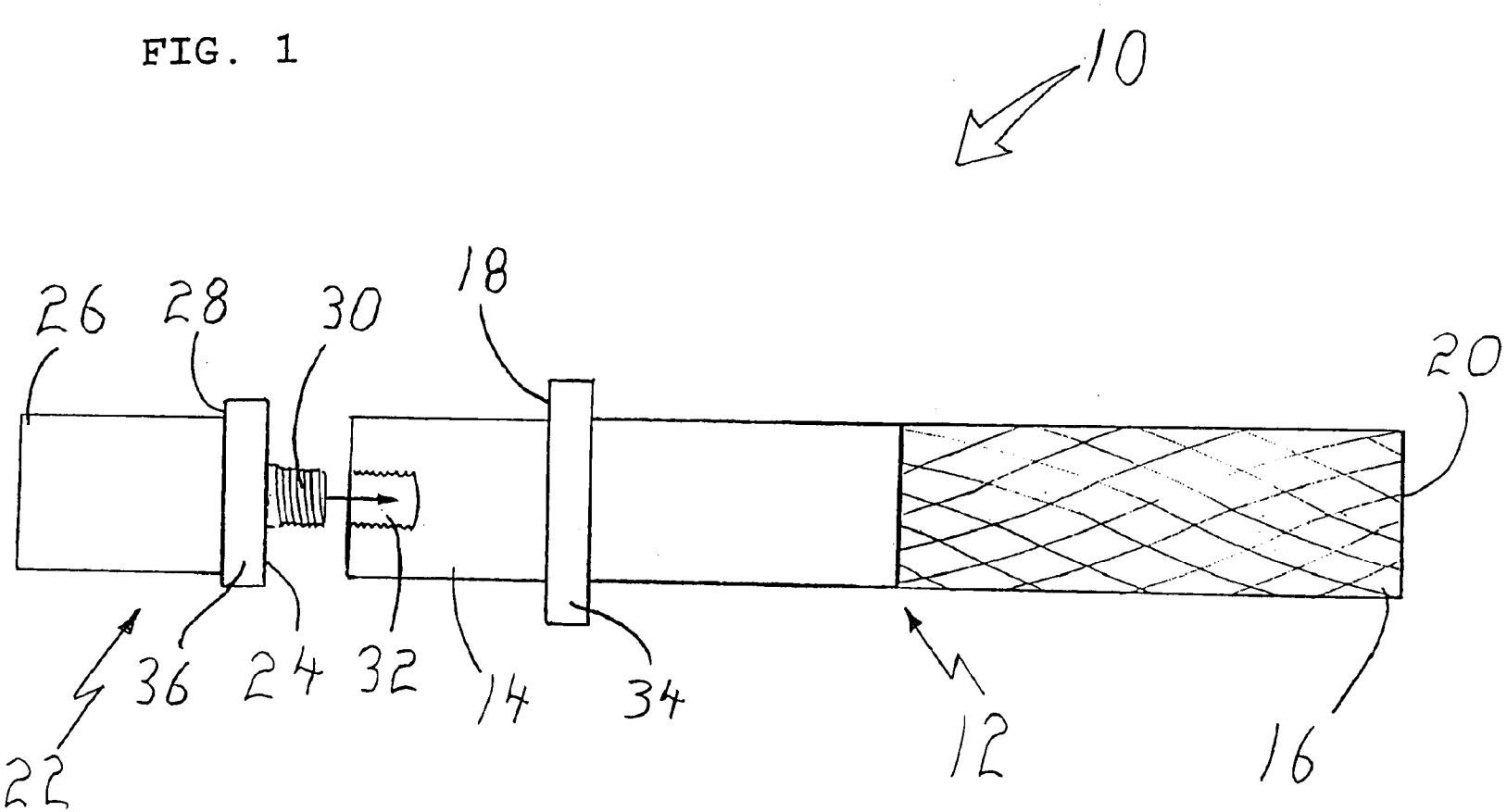
FIG. 1 is an exploded side elevation view of a bushing driver constructed in accordance with the teachings of the present invention.

The preferred embodiment, a bushing driver generally identified by reference numeral 10, will now be described with reference to FIGS. 1 and 2.

Figure 2:
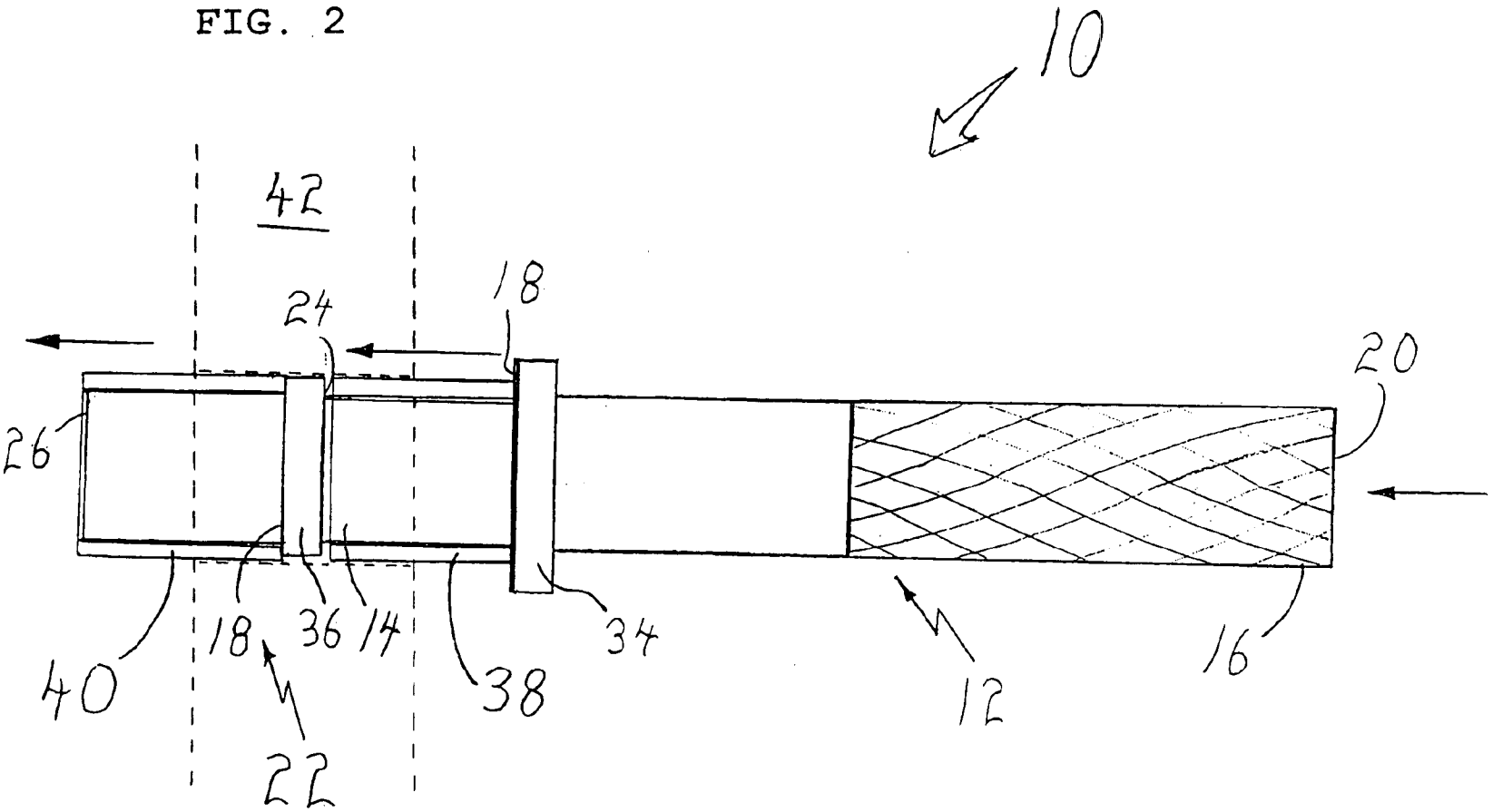
FIG. 2 is a side elevation view of the bushing driver illustrated in FIG. 1, being used to concurrently remove a worn bushing and install a new bushing.

Structure and Relationship of Parts:

Referring to FIG. 1, bushing driver 10 has a first body 12 having a first end 14 and a second end 16. A new bushing interface 18 is positioned adjacent to first end 14 of first body 12. An anvil 20 is positioned at second end 16 of first body 12. Bushing driver 10 is further adapted with a second body 22 having a first end 24 and a second end 26. A worn bushing interface 28 is positioned adjacent to first end 24 of second body 22. Means for detachably coupling second body 22 to first body 12 is provided. In the illustrated embodiment the means for detachable coupling is a threaded male coupling 30 at first end 24 of second body 22. Threaded male coupling 30 engages a threaded female coupling 32 at first end 14 of first body 12 such that first body 12 and second body 22 are detachably coupled as illustrated in FIG. 2. Referring to FIG. 1, in the illustrated embodiment, new bushing interface 18 and worn bushing interface 28 are in the form of a first annular flange 34 and a second annular flange 36 respectively.

Operation:

The use and operation of bushing driver 10 will now be described with reference to FIGS. 1 and 2. Referring to FIG. 2, a new bushing 38 is positioned at first annular flange 34. This step was accomplished when first body 12 and second body 22 were detached as shown in FIG. 1. Once new bushing 38 is positioned, first body 12 and second body 22 are attached by engaging threaded male coupling 30 with threaded female coupling 32. Referring to FIG. 2, second body 22 is positioned against a worn bushing 40, which was fitted within an object body 42. In the illustrated embodiment, as force is applied to anvil 20, worn bushing 40 is driven out of object body 42 by contact with worn bushing interface 28. At the same time, new bushing 38 is driven into object body 42 by new bushing interface 18. It will be understood from the above description, that bushing driver 10 is capable of performing the removal of a worn bushing and the replacement of the worn bushing with a new bushing in a single operation. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A bushing driver, comprising:

a first body having a first end and a second end;

a new bushing interface positioned adjacent the first end of the first body;

an anvil positioned at the second end of the first body;

a second body having a first end and a second end;

a worn bushing interface positioned adjacent to the first end of the second body;

means for detachably coupling the second end of the second body to the first end of the first body with the worn bushing interface axially aligned with the new bushing interface, such that as a worn bushing is driven out by the worn bushing interface on the second body, a new bushing positioned on the new bushing interface is concurrently driven into the space vacated by the worn bushing.

2. The bushing driver as defined in claim 1, wherein one of the second end of the second body and the first end of the first body has a threaded male coupling and the other has a threaded female coupling, whereby the first body and the second body are detachably coupled.

3. The bushing driver as defined in claim 1, wherein the new bushing interface is a first annular flange and the worn bushing interface is a second annular flange.

* * * * *